US007922468B2

(12) United States Patent
Chang

(10) Patent No.: US 7,922,468 B2
(45) Date of Patent: Apr. 12, 2011

(54) GEAR PUMP WITH IMPROVED INLET PORT

(75) Inventor: Peter Lit Ming Chang, Scarborough (CA)

(73) Assignee: MAGNA Powertrain, Inc., Concord, ON (CA)

( * ) Notice: Subject to any disclaimer, the term of this patent is extended or adjusted under 35 U.S.C. 154(b) by 702 days.

(21) Appl. No.: 11/917,910

(22) PCT Filed: Jun. 22, 2006

(86) PCT No.: PCT/CA2006/000998
§ 371 (c)(1),
(2), (4) Date: Dec. 18, 2007

(87) PCT Pub. No.: WO2006/136014
PCT Pub. Date: Dec. 28, 2006

(65) Prior Publication Data

US 2010/0215537 A1 Aug. 26, 2010

(51) Int. Cl.
*F03C 4/00* (2006.01)
*F04C 18/00* (2006.01)
*F04C 2/00* (2006.01)

(52) U.S. Cl. ..... 418/171; 418/189; 418/190

(58) Field of Classification Search ..... 418/166, 418/171, 61.3, 189, 190
See application file for complete search history.

(56) References Cited

U.S. PATENT DOCUMENTS

| | | | | |
|---|---|---|---|---|
| 3,515,496 | A | 6/1970 | Eddy | |
| 3,715,177 | A * | 2/1973 | Woodier | 418/171 |
| 3,865,519 | A | 2/1975 | Lepelletier | |
| 4,836,760 | A | 6/1989 | MacLeod | |
| 5,660,531 | A | 8/1997 | Merkle et al. | |
| 5,711,660 | A | 1/1998 | Mitarai et al. | |
| 6,419,469 | B1 | 7/2002 | Shulver et al. | |
| 6,544,013 | B2 | 4/2003 | Kato et al. | |
| 6,835,054 | B2 | 12/2004 | Morita | |
| 6,896,500 | B2 | 5/2005 | Ike et al. | |
| 2003/0026722 | A1 | 2/2003 | Takagi et al. | |

FOREIGN PATENT DOCUMENTS

| | | | |
|---|---|---|---|
| EP | 1 087 139 B1 | | 11/2004 |
| JP | 61008485 A | * | 1/1986 |
| JP | 03242482 A | * | 10/1991 |
| JP | 04005476 A | * | 1/1992 |
| JP | 05079463 A | * | 3/1993 |

* cited by examiner

*Primary Examiner* — Theresa Trieu
(74) *Attorney, Agent, or Firm* — Harness, Dickey & Pierce, P.L.C.

(57) ABSTRACT

A gear pump is provided and includes an inlet port which terminates, in the pumping direction of the rotor set, in a radially inwardly extending ramp portion. The ramp portion operates to direct working fluid from an inlet radially inwardly into a pumping chamber of the rotor set which is passing over the ramp portion. By closing the pumping chamber at a radially inwardly point, the filling efficiency of the pumping chamber is improved, reducing cavitation and/or operating noise of the pump.

17 Claims, 7 Drawing Sheets

GEAR PUMP WITH IMPROVED INLET PORT

FIELD OF THE INVENTION

The present invention relates to positive displacement pumps. More specifically, the present invention relates to a gear pump with an improved inlet port.

BACKGROUND OF THE INVENTION

Gear pumps, such as gerotor pumps, are well known and have been widely employed in a variety of applications for a number of years. Such pumps are positive displacement pumps wherein a rotor set, comprising an inner rotor having a given number of teeth N and an outer rotor having at least N+1 teeth, is rotated to pressurize a working fluid.

The center of rotation of the inner rotor of the rotor set is located eccentrically to the center of rotation of the outer rotor of the rotor set such that, as the rotor set is driven, a series of variable volume pumping chambers are formed between the teeth of the inner rotor and outer rotor. As the volume of a pumping chamber begins to increase, that pumping chamber enters into fluid communication with the inlet port of the pump so that low pressure working fluid is drawn into the pumping chamber. As the rotor set continues to rotate, the volume of the pumping chamber reaches its maximum and the chamber moves such that it is no longer in fluid communication with the inlet port resulting in the pressurization of the working fluid. As the rotor set continues to further rotate, the volume of the pumping chamber begins to reduce and the pumping chamber enters into fluid communication with the outlet port of the pump. As the volume of the pumping chamber continues to reduce, the working fluid therein is expressed into the outlet port and then into the pump outlet.

While such pumps are widely employed, they do suffer from problems. In particular, it has proven difficult to fill the pumping chamber from the pump inlet when the inlet pressure is low and/or when the operating speed of the pump is high and such difficulties can result in cavitation and increased operating noise. Most early approaches to improving filling of the pumping chambers comprised attempts to provide inlet ports of the largest practical size. However, the results obtained from such designs where less than satisfactory in many applications for a variety of reasons.

U.S. Pat. No. 4,836,760 to MacLeod teaches another approach to enhancing the filling of pumping chambers wherein the inlet port is located radially inward of the outer diameter of the pumping chambers. MacLeod recognized that, due to the centrifugal forces developed by rotation of the rotor set, the working fluid in the pumping chambers experiences a pressure gradient with the fluid adjacent the outer diameter of the rotor set being at the highest pressure. By moving the inlet port radially inward, MacLeod teaches improved filling as the working fluid enters the pumping chamber a point wherein the pressure of the working fluid which had already entered the pumping chamber is less than the higher pressure working fluid adjacent the outer diameter of the rotor.

Other, more recent, approaches have involved lengthening the inlet port in the direction of rotation of the rotor set adjacent the outer radial portion, the inner radial portion or both, of the pumping chambers. However, these solutions also provide less than the desired level of filling efficiency.

U.S. Pat. No. 6,896,500 to Ike et al. teaches decreasing the depth of the inlet port such that it is relatively shallow just before the pumping chambers close, apparently in an effort to direct working fluid into the pumping chamber to better fill it.

Despite the teachings of MacLeod and others, gear pumps still suffer from undesirable cavitation and operating noise due to inefficiencies in filling the pumping chambers.

SUMMARY OF THE INVENTION

It is an object of the present invention to provide a novel gear pump which obviates or mitigates at least one disadvantage of the prior art.

According to a first aspect of the present invention, there is provided a gear pump for a working fluid comprising: a pump housing defining a rotor chamber and a pump inlet and a pump outlet; a rotor set in the rotor chamber, the rotor set comprising an inner rotor and an outer rotor, the inner rotor being rotatable to rotate the rotor set, the teeth of the inner and outer rotors moving in and out of mesh as the rotor set rotates forming pumping chambers between the rotor teeth, the volume of the pumping chambers varying as the teeth move in and out of mesh; an outlet port in fluid communication with the pump outlet and receiving pressurized working fluid from the pumping chambers at the angular position of the rotor set where the volume of the pumping chambers decreases; and an inlet port in fluid communication with the pump inlet to receive working fluid from the pump inlet to the pumping chambers at the angular position of the rotor set where the volume of the pumping chambers increases, the inlet port terminating in the rotation direction of the rotor set with a radially inwardly extending ramp portion, the ramp portion operating to direct working fluid radially inwardly into the pump chamber passing over the ramp portion to substantially fill the pumping chamber.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
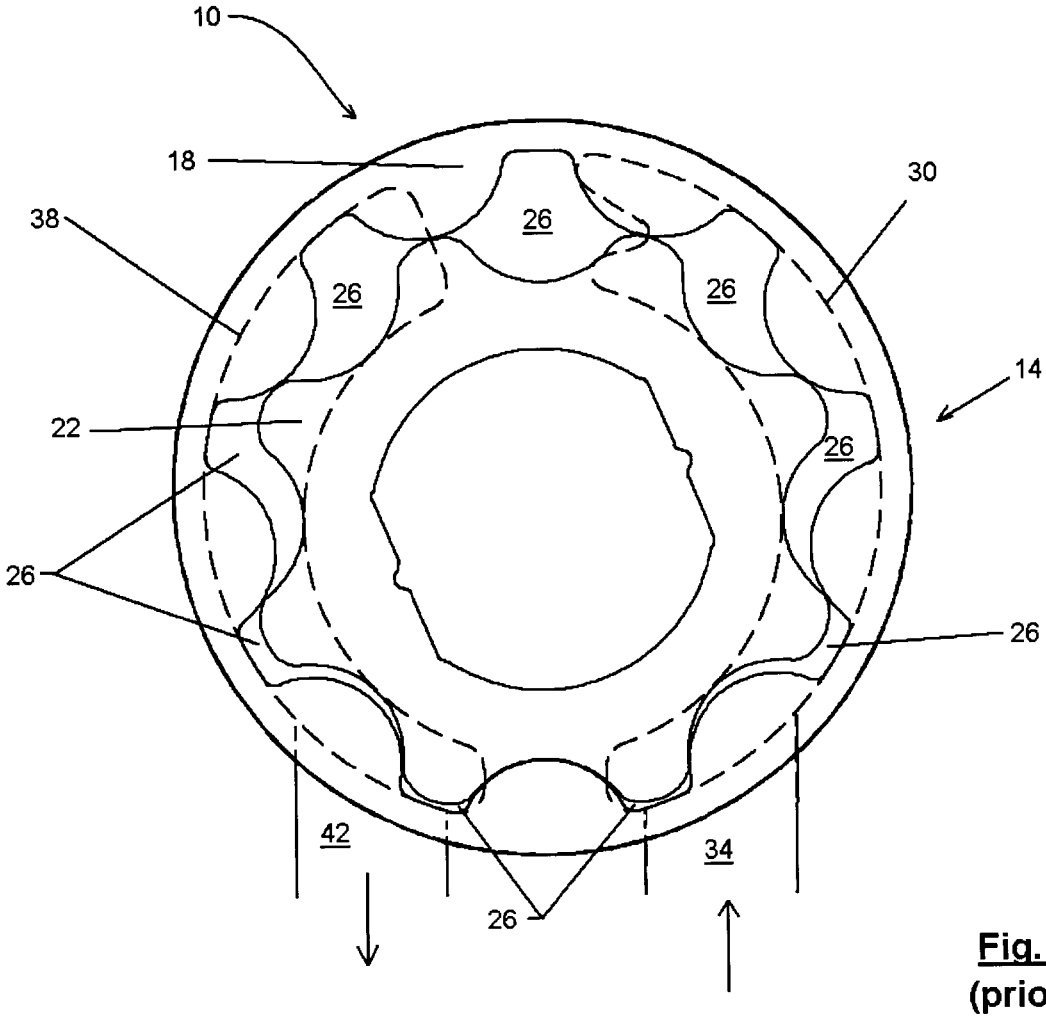
Fig. 1 (prior art)
FIG. 1 shows a rotor set and inlet and outlet ports for a conventional gear pump.

A conventional gear pump is indicated at 10 in FIG. 1. In the Figure, pump 10 includes a rotor set 14 comprising an outer rotor 18 and an inner rotor 22. Inner rotor 22 is driven by a prime mover (not shown) and rotates rotor set 14 within a pump housing, not shown, and in the illustrated configuration, rotor set 14 rotates in a counter clockwise or pumping direction.

As rotor set 14 is rotated, the teeth of inner rotor 22 mesh and unmesh with the teeth of outer rotor 18 to form a series of successive pumping chambers 26. As will be apparent, the volume of each pumping chamber 26 varies as rotor set 14 rotates within the pump housing.

Rotor set 14 overlies the inlet port 30 (indicated in dashed line) which is in fluid communication with the inlet 34 for pump 10. Inlet port 30 is supplied with working fluid from inlet 34 and allows working fluid to enter the pumping chambers 26 as their volume starts to increase.

Rotor set 14 also overlies the outlet port 38 (also indicated in dashed line) which is in fluid communication with the outlet 42 of pump 10. Outlet port 38 is supplied with working fluid which is pressurized in pumping chambers 26 as their volume decreases as rotor set 14 rotates.

Figure 2:
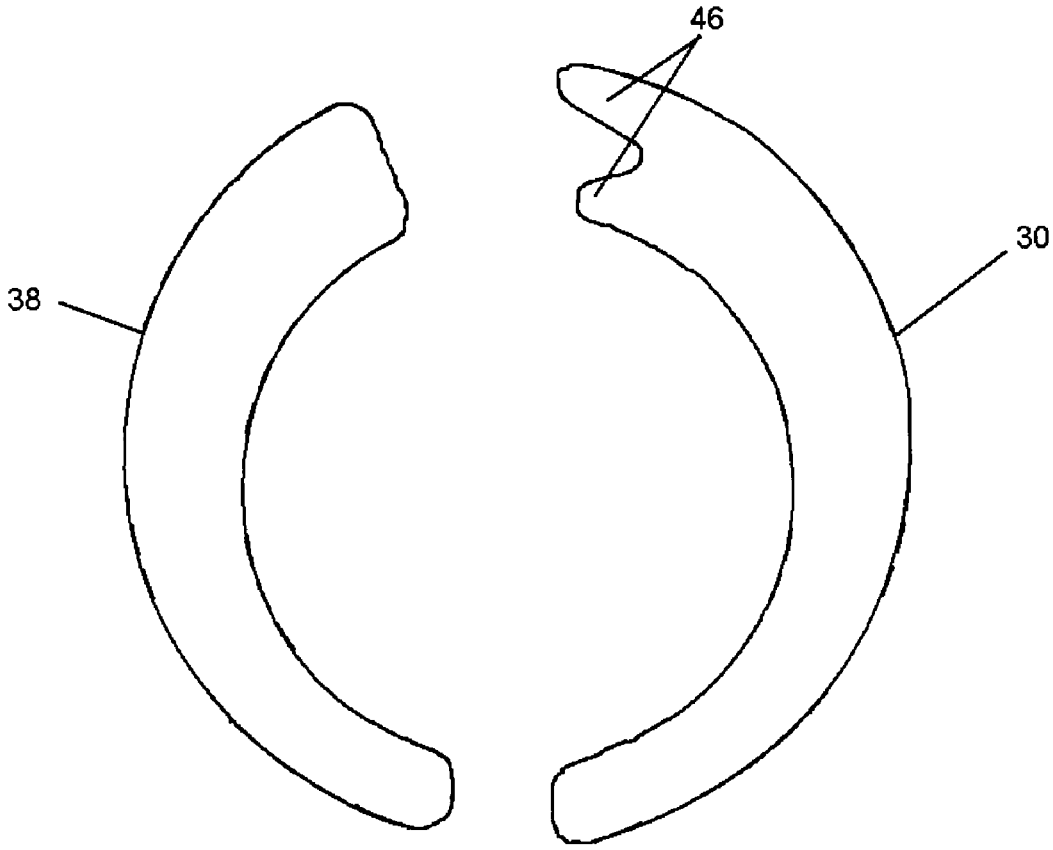
Fig. 2 (prior art)
FIG. 2 shows the port geometries for the pump of FIG. 1.

The geometries of inlet port 30 and outlet port 38 are better seen in FIG. 2 and, in particular, the lengthened portions 46 of inlet port 30 in the direction of rotation of the rotor set 14 adjacent the outer radial portion and the inner radial portion of the pumping chambers 26 can be seen. Lengthened portions 46 are commonly referred to in the art as a "rooster tail" and are intended to improve filling of pumping chambers 26 and are one of the most common approaches to improving filing of the pumping chambers.

However, pumps with such rooster tails still suffer from cavitation and/or operating noise due to inefficiencies in filling the pumping chambers. Due to the momentum of the fluid in pumping chambers 26, the working fluid is forced radially outward resulting in pumping chambers 26 effectively being partitioned into a radially outer high pressure region and a radially inner lower pressure region. The higher pressure fluid tends to leak back into pump inlet 30, resulting in inefficient filling of the pumping chambers 26. Lengthened portions 46, which are essentially an attempt to lengthen the time for filling of the pumping chamber, actually tend to increase this leakage as the higher pressure working fluid is in communication with inlet port 30, via lengthened portions 46, for a longer period of time. Specifically, the working fluid in the pumping chambers which is at a higher pressure, i.e.—the working fluid at the outer radial periphery of the pumping chamber, than the pressure of the working fluid in the inlet leaks back into the inlet.

Figure 3:
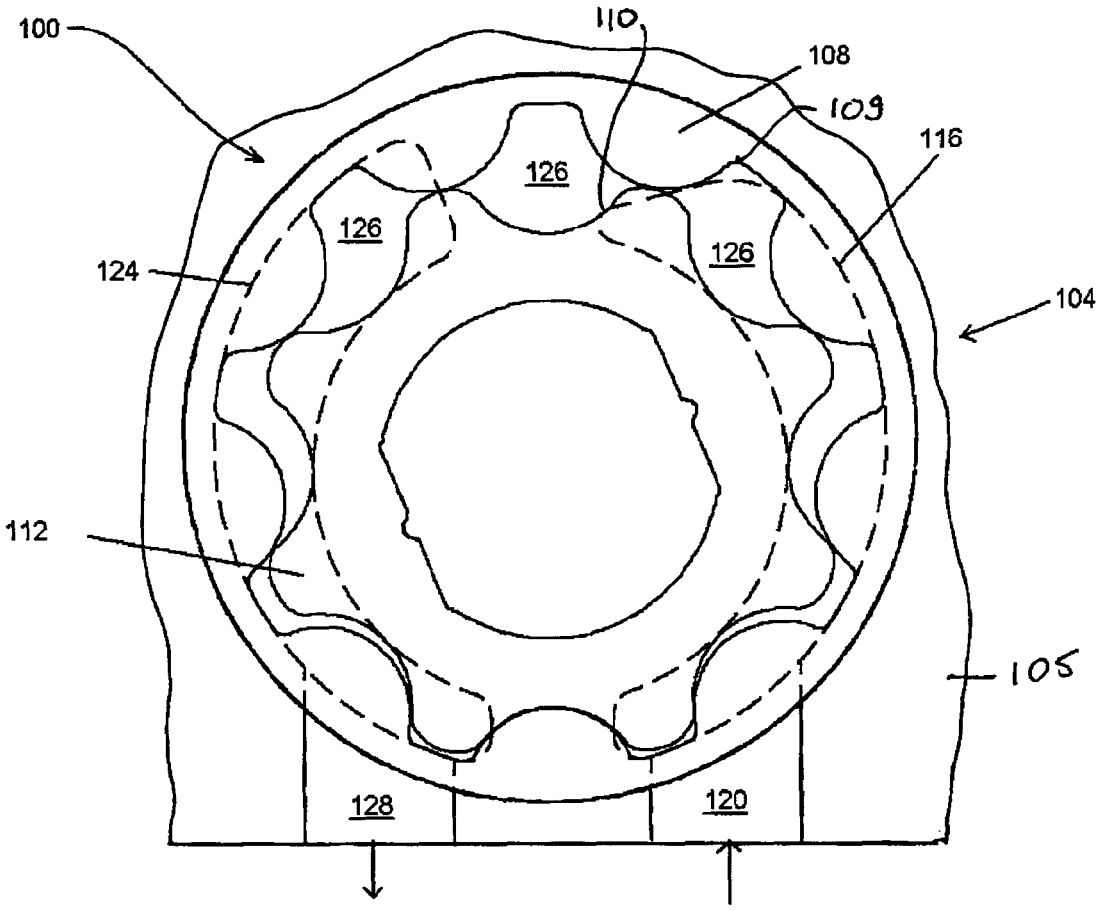
FIG. 3 shows a rotor set and inlet and outlet ports for a gear pump in accordance with the present invention.

FIG. 3 shows a gear pump 100 in accordance with the present invention. Pump 100 comprises a rotor set 104 including an outer rotor 108 and an inner rotor 112. Inner rotor 112 is driven by a prime mover (not shown) and rotates rotor set 104 within a pump housing 105, and in the illustrated configuration, rotor set 104 rotates counter clockwise pumping direction.

As before, the teeth of inner rotor 112 and outer rotor 108 form a series of successive pumping chambers 126 between the peaks and valleys of the teeth. The pumping chambers each has a volume that varies as rotor set 104 rotates in a pumping direction within the pump housing. As the teeth of the inner rotor 112 move away from the teeth of the outer rotor 108, the volume of the pumping chambers 126 increases up to a maximum volume. At maximum volume at top dead center, the peaks of adjacent teeth of inner rotor 112 contact the peaks of adjacent teeth of the outer rotor 108. Further rotation will cause the teeth of the inner rotor 112 to move relatively towards or into engagement with the teeth of the outer rotor 108, which will reduce the volume of the pumping chambers 126 to a minimum volume at bottom dead center. At the minimum volume, the peak of a tooth of the outer rotor 108 will be nested within the root between adjacent teeth of the inner rotor 112.

Rotor set 104 overlies the inlet port 116 (indicated in dashed line) which is in fluid communication with the inlet 120 for pump 100. Inlet port 116 is supplied with working fluid from inlet 120 and allows working fluid to enter the pumping chambers 126 formed by rotor set 104 as their volume starts to increase.

Rotor set 104 also overlies the outlet port 124 (also indicated in dashed line) which is in fluid communication with the outlet 128 for pump 100. Outlet port 124 is supplied with working fluid which is pressurized in the pumping chambers 126 as their volume decreases as rotor set 104 rotates.

Figure 4:
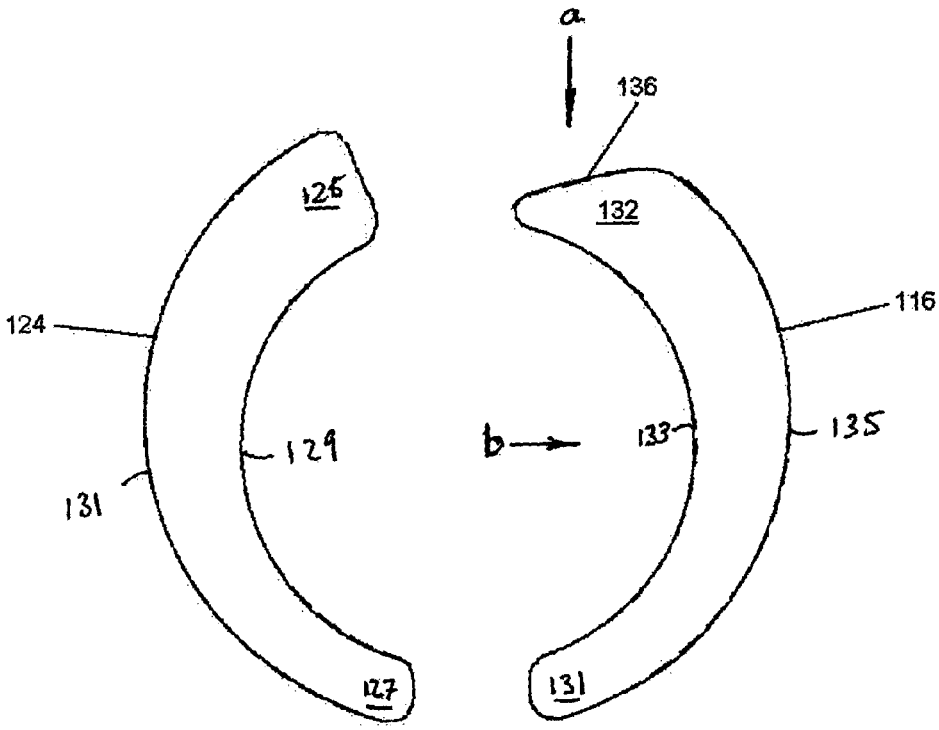
FIG. 4 shows the port geometries for the pump of FIG. 3.

The geometries of outlet port 124 and, in particular, inlet port 116, are better seen in FIG. 4. As shown, outlet port 124 has a conventional configuration, having an upstream end 125, a downstream end 127, inner side wall 129 and outer side wall 131. The inner side wall 129 extends from the upstream end 125 to the downstream end portion 127 along the radial line joining the roots of the teeth of inner rotor 112. The outer side wall 131 extends from the upstream end to the downstream end 127 along the radial line joining the roots of the teeth of the outer rotor 108. Since the inner rotor 112 and the outer rotor 108 are not concentric, the side walls 129 and 131 are also not concentric and have a predetermined offset, depending on the geometry of the teeth.

Inlet port 116 has an upstream end 131 and terminates in a rotation direction of the rotor set 104 with a radially inwardly tapered downstream end portion 132, referred to by the present inventor as a "goose head". The inner side wall 133 extends from the upstream end 131 to the downstream end portion 132 along the radial line joining the roots of the teeth of inner rotor 112. The outer side wall 135 extends from the upstream end to the downstream end portion 132 along the radial line joining the roots of the teeth of the outer rotor 108. The side walls 133 and 135 are also not concentric and have a predetermined offset, depending on the geometry of the teeth.

End portion 132 includes a ramp portion 136 which extends from the inner side wall 133 to the outer side wall 135. Ramp portion 136 operates to channel working fluid from inlet 116 to the radially inner lower pressure regions of the series of pumping chambers passing over end portion 132, thus resulting in improved filling of the pumping chamber.

The orientation of end portion 132 is designed to direct working fluid from inlet 116 to fill the radially inner, lower pressure, region of pumping chambers 126 after the radially outer, higher pressure, portion has been filled and to minimize leakage from the higher pressure portion back into inlet 116. In particular, as the outermost infinitesimal volume of the radially outer, high pressure, portion of a pumping chamber 126 is filled to its maximum, it is sealed by passing over end portion 132, preventing its leaking back into inlet 116. In other words, the leading edge 109 of the root of outer rotor 108 is the first point of the radially outer portion that passes over the end portion 132 to begin the closing sequence. The next infinitesimal volume of pumping chamber 126, adjacent the first infinitesimal volume, is then filled and is also sealed as it passes over end portion 132. This process continues progressively until the entire high pressure, radially outer, region and then the lower pressure, radially inner portions of pumping chamber 126 are filled. The radially inner portion of the pumping chambers 126 is last to be filled and closed. The radially inner portion is near the roots or troughs of adjacent teeth of the inner rotor 112. Due to the curvature of the teeth and the configuration of the end portion 132, the last to close location will be on the trailing edge 110, which is in the vicinity of a radial line joining the roots of the teeth of inner rotor 112. In other words, end portion 132 cooperates with the inner and outer rotors to close progressively the pumping chamber 126 from the radially outer portion to the radially inner portion.

Figures 7A, 7B:
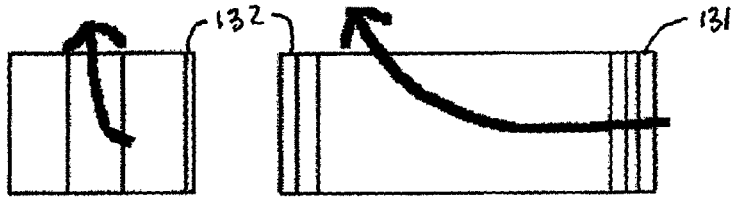
FIGS. 7*a* and 7*b* show side schematic views of the inlet port contours of FIG. 3 from directions of arrows a and b, respectively.
Figures 8A, 8B:
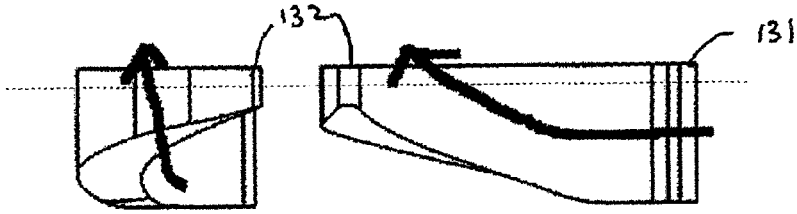
FIGS. 8*a* and 8*b* show side schematic views of an alternate ramped inlet port contour of FIG. 3 from directions of arrows a and b, respectively.

Referring to FIGS. 7 and 8, the inlet port 116 can have a uniform depth as shown in FIGS. 7*a* and 7*b*. If desired, the depth of inlet port 116 can be decreased, from a maximum depth upstream (towards pump inlet 120) to a minimum depth adjacent end portion 132, as shown in FIG. 8*a* and FIG. 8*b*. It is contemplated that, for some operating conditions and/or working fluids, decreasing the depth of inlet port 116 in such a manner can further improve the filling efficiency of pumping chambers 126.

In addition to the advantages described above, the present invention also has the advantage that pumping chambers 126 only have a single closing point, rather than the two closing points of the prior art "rooster tail" designs. As is apparent to those of skill in the art, by eliminating a closing point, and the corresponding dead zone of fluid in pumping chamber 126, the associated eddies and turbulence are also reduced, further enhancing filling of pumping chamber 126 and improving the efficiency of the pump, as fluid energy is not expended to create these eddies and turbulence. Further, preferably the single closing point is located adjacent the pressure deficient region (less filled) within the pumping chamber, near, or on, the minor diameter of inner rotor 112, when the closing point is approached by the pumping chamber (i.e. when the pumping chamber is about to be sealed completely from the inlet port).

Figure 5:
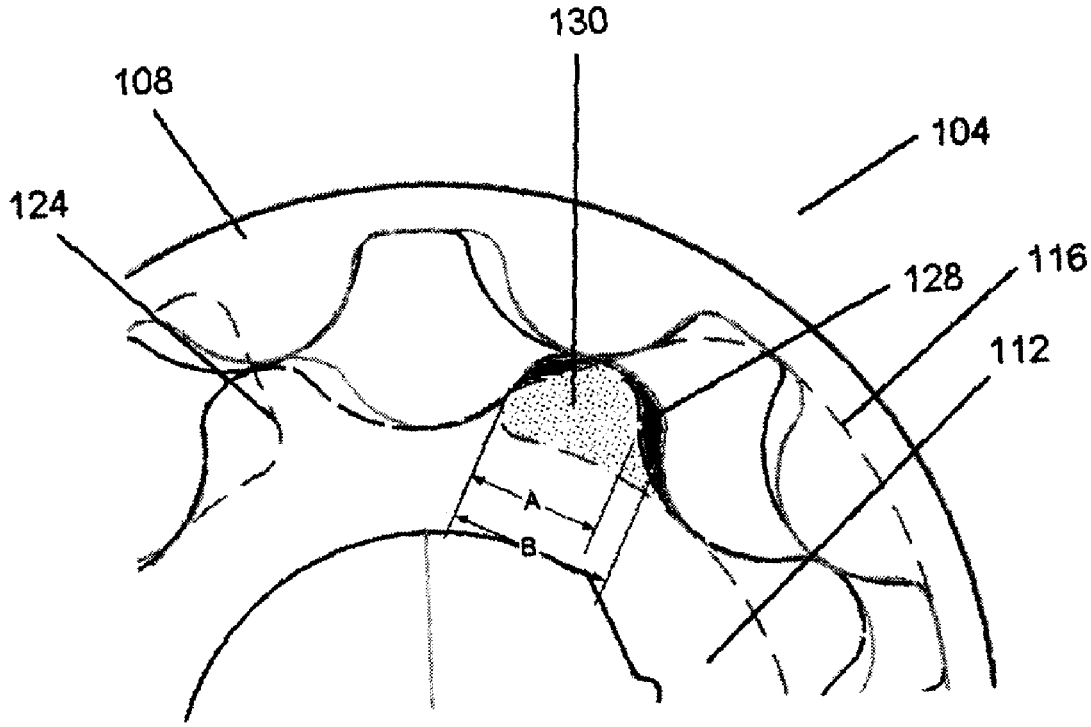
FIG. 5 shows a portion of the rotor set of FIG. 3 showing the effects of the thickness of the inner rotor teeth.

Further, it has been determined that improvements in pumping chamber filling efficiency are obtained from rotor set designs wherein the thickness (i.e.—width) of teeth of inner rotor 112 is reduced or at a minimum, and the conjugate tooth design of outer rotor 108 correspondingly modified, to reduce the size of the dead zone created when the pumping chamber is filling. FIG. 5 shows a portion of a rotor set 104 wherein the effects of two different tooth thicknesses of inner rotor 112 are shown. As illustrated, a thicker tooth, indicated by "B" in the Figure, results in a larger dead zone 128, than a thinner tooth thickness, indicated by "A" in the Figure, which results in the smaller dead zone 130.

Figure 6A:
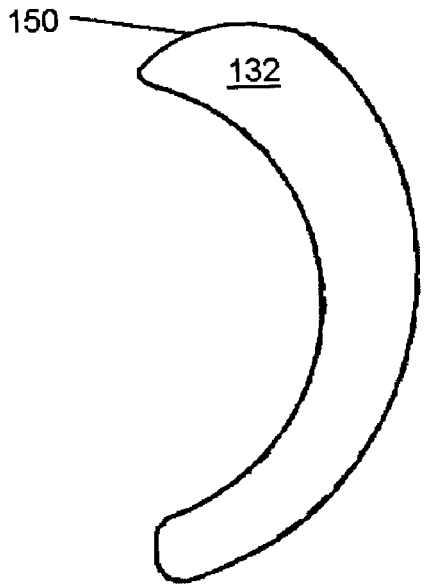
FIGS. 6*a* through 6*d* show some other possible inlet port geometries for the pump of FIG. 3.
Figure 6B:
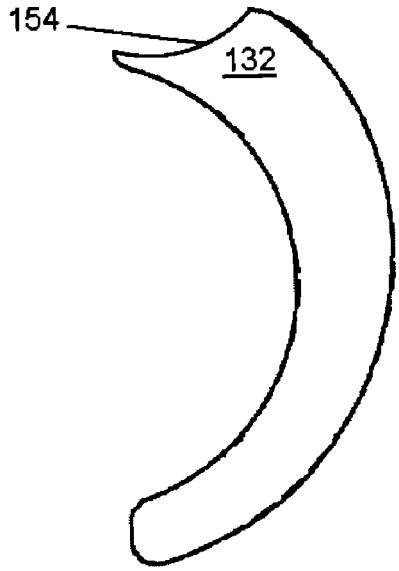
Figure 6C:
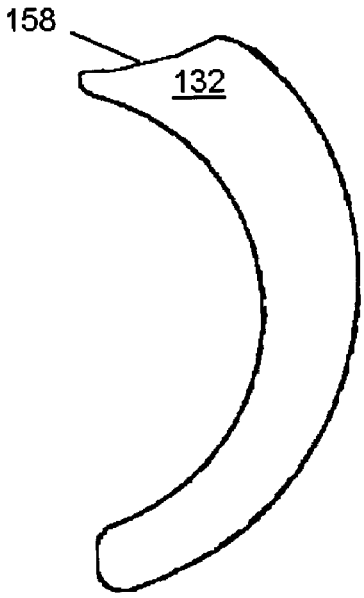
Figure 6D:
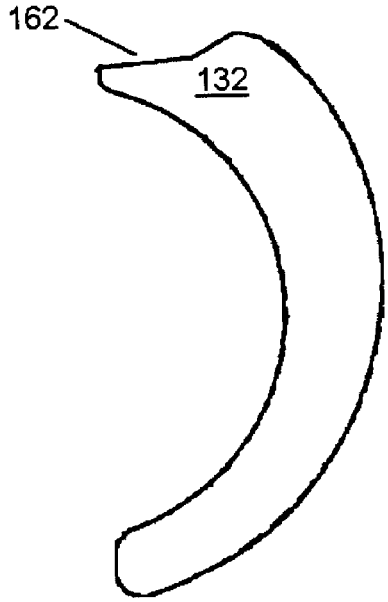

FIGS. 6*a* through 6*d* show examples of other geometries for end portion 132. FIG. 6*a* shows an embodiment wherein end portion 132 features a convex ramp portion 150. FIG. 6*b* shows an embodiment wherein end portion 132 features a concave ramp portion 154. FIG. 6*c* shows an embodiment wherein end portion 132 features a three-plane ramp portion 158 and FIG. 6*d* shows an embodiment wherein end portion 132 features a two plane ramp portion 162. It is contemplated that these, or other ramp portion designs of end portion 132, including ramp portions with more than two planes, can be advantageously employed depending the design of rotor set 104, the working fluid for which pump 100 is designed for, the radial size of rotor set 104 and the intended operating speed of pump 100.

The present invention is believed to be particularly useful and advantageous when pump 100 is crankshaft mounted on an internal combustion engine, or in-line mounted on a transmission or used in other applications wherein the driving diameter of inner rotor 112 is relatively large, resulting in large centrifugal force and high velocities on the working fluid. By employing the above-described configuration of inlet port 116, improved filling of pumping chambers 126 is obtained, as are improved pump efficiencies.

Figure 9:
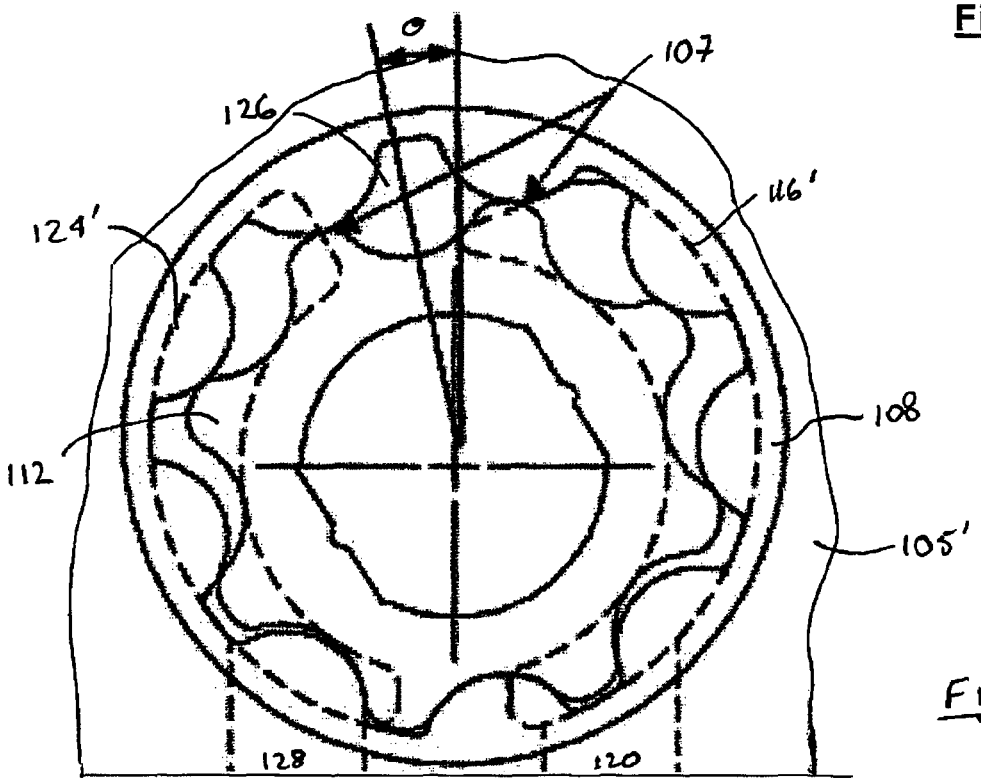
FIG. 9 shows port geometries of the pump of FIG. 3, with an alternate retarded port geometry.

Referring to FIG. 9, the efficiency of the pump 100 can be further improved for high RPM applications by retarding the angular position of maximum volume pumping chamber 126 at top dead center by an angle θ, and then configuring the inlet and outlet ports 116' & 124' to achieve the desired seal and thus pumping action of the pump. Retarding the ports by a specified angle does not necessarily mean that both ports (i.e. inlet & outlet) are retarded by the same angle. Essentially, the manner of retarding the ports consists of rotating the rotors 108, 112 a desired degree when the pumping chamber 126 is at a maximum volume. Maximum volume, as seen in FIG. 3, when the peaks of the teeth of inner rotor 112 contact the peaks of the outer rotor 108 at contact points 107. The desired degree ranges from 1 to 20°. The goose-head inlet and outlet ports 116' and 124' are then located at the angular position to close the pumping chamber 126 and then open the pumping chamber 126 for discharge. Essentially, the retardation of the pumping chamber 126 enables inlet fluid to communicate longer with the inlet port 116' after top dead center further improving filling. Retardation of the inlet port 116' increases the time of fluid communication but negatively impacts displacement.

Figure 10:
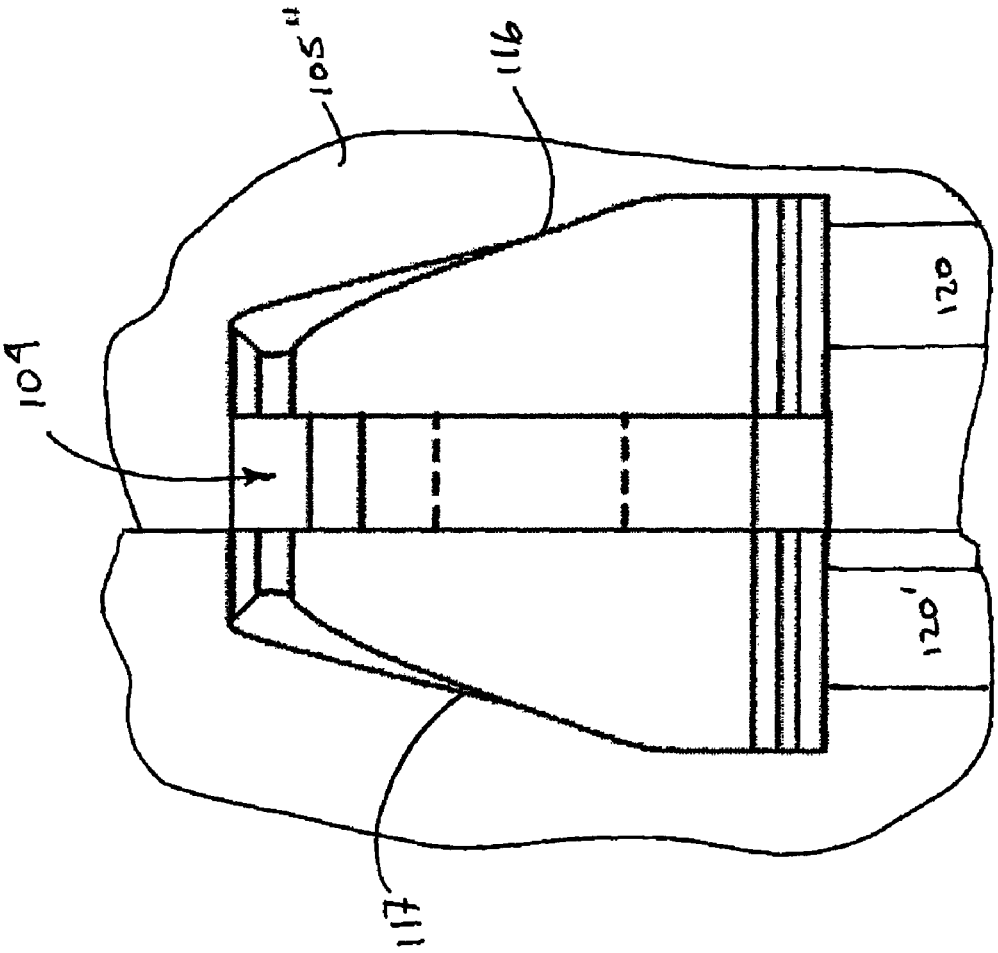
FIG. 10 show plan schematic view of a dual inlet port contour.

Optionally, the housing 105"can be provided with dual filling of the pumping chambers as illustrated in FIG. 10. Dual filling provides a secondary inlet port 117 directly opposite the inlet port 116 in order to fill the pumping chambers from both sides of the rotor set 104. Inlet port 117 communicates with inlet 120' which communicates with inlet 120. The dual inlet ports do not necessarily have to be symmetrical or even angularly symmetrical about the pumping chambers. Dual inlet ports coupled with the goose-head design further improves filling efficiency of the pumping chamber resulting in both cavitation and noise reductions.

The above-described embodiments of the invention are intended to be examples of the present invention and alterations and modifications may be effected thereto, by those of skill in the art, without departing from the scope of the invention which is defined solely by the claims appended hereto.

What is claimed is:

1. A gear pump for a working fluid comprising:

a pump housing defining a rotor chamber and a pump inlet and a pump outlet;

a rotor set in the rotor chamber and rotatable in a pumping direction, the rotor set comprising an inner rotor and an outer rotor, the inner and outer rotors each having teeth that move in and out of meshing engagement as the rotor set rotates forming a series of successive pumping chambers between the rotor teeth, each pumping chamber having a volume that increases as the teeth move out of meshing engagement and decreases as the teeth move into meshing engagement;

an outlet port in fluid communication between the pump outlet and the pumping chambers as the volume of the pumping chambers decreases; and an inlet port in fluid communication between the pump inlet and the pumping chambers as the volume of the pumping chambers increases, the inlet port terminating in the pumping direction with a radially inwardly extending ramp portion, the ramp portion operating to close each successive pump chamber at a radially inner portion.

2. The gear pump of claim 1 wherein the ramp portion operates to initiate closing of each of the pumping chambers at a radially outer portion and progresses to said radially inner portion.

3. The gear pump of claim 2 wherein the ramp portion is generally convex in the pumping direction of the rotor set.

4. The gear pump of claim 2 wherein the ramp portion is generally concave in the pumping direction of the rotor set.

5. The gear pump of claim 2 wherein the ramp portion is formed from at least two planar portions.

6. The gear pump of claim 2 wherein the depth of the inlet port decreases in the pumping direction of the rotor set.

7. The gear pump of claim 3 wherein the depth of the inlet port decreases in the pumping direction of the rotor set.

8. The gear pump of claim 4 wherein the depth of the inlet port decreases in the pumping direction of the rotor set.

9. The gear pump of claim 5 wherein the depth of the inlet port decreases in the pumping direction of the rotor set.

10. The gear pump of claim 2 wherein each of the teeth of the inner rotor has a circumferential width that is selected to have a relatively thin profile to reduce a dead zone formed as each of the pumping chambers pass the downstream end of said inlet port.

11. The gear pump of claim 2 wherein the rotor set is designed such that each of the pumping chambers close at a point near a root diameter of the inner rotor.

12. The gear pump of claim 2 wherein a downstream end of the inlet port and an upstream end of the outlet port are retarded in the pumping direction.

13. The gear pump of claim 12 wherein the inlet port and the outlet port are retarded by 1° to 20° relative to top dead center.

14. The gear pump of claim 1 wherein said ramp portion directs said fluid radially inward.

15. The gear pump of claim 1, wherein said ramp portion progressively closes each successive pump chamber.

16. The gear pump of claim 1, further comprising a secondary inlet port in fluid communication between the pump inlet and the pumping chambers as the volume of the pumping chambers increases, the secondary inlet port on a side of the rotor set opposite from said inlet port.

17. The gear pump of claim 16, wherein said secondary inlet port is symmetrical with said inlet port.

* * * * *